US009078321B2

(12) United States Patent
Sun et al.

(10) Patent No.: US 9,078,321 B2
(45) **Date of Patent: *Jul. 7, 2015**

(54) LIGHT EMITTING SYSTEM WITH LIGHT EMITTING POWER STABILIZATION

(75) Inventors: Tai-Ping Sun, Jhongli (TW); Chia-Hung Wang, Taichung (TW); Jia-Hao Li, Puli Township (TW)

(73) Assignee: Naitonal Chi Nan University, Nantou (TW)

( * ) Notice: Subject to any disclaimer, the term of this patent is extended or adjusted under 35 U.S.C. 154(b) by 374 days.

This patent is subject to a terminal disclaimer.

(21) Appl. No.: 13/555,666

(22) Filed: Jul. 23, 2012

(65) Prior Publication Data

US 2013/0076267 A1 Mar. 28, 2013

(30) Foreign Application Priority Data

Sep. 27, 2011 (TW) ..... 100134766 A

(51) Int. Cl.
*H05B 33/08* (2006.01)

(52) U.S. Cl.
CPC ..... *H05B 33/0824* (2013.01)

(58) Field of Classification Search
None
See application file for complete search history.

(56) References Cited

U.S. PATENT DOCUMENTS

2014/0009072 A1* 1/2014 Sun et al. ..... 315/158

* cited by examiner

*Primary Examiner* — Douglas W Owens
*Assistant Examiner* — Dedei K Hammond
(74) *Attorney, Agent, or Firm* — LeClairRyan

(57) ABSTRACT

A light emitting system includes: a voltage detecting unit connected across a solid-state light emitting component for detecting a forward voltage thereof and generating a detection voltage having a magnitude dependent on the forward voltage; a current control unit connected to the light emitting component for controlling, according to a compensation voltage, flow of an operating current, which has a magnitude dependent on the compensation voltage, therethrough; and a compensation voltage module connected to the voltage detecting unit and the current control unit, disposed to receive a reference voltage, and configured to generate the compensation voltage, which varies according to the forward voltage, for provision to the current control unit according to the detection voltage, an operating voltage having a magnitude dependent on the operating current, and the reference voltage.

32 Claims, 6 Drawing Sheets

LIGHT EMITTING SYSTEM WITH LIGHT EMITTING POWER STABILIZATION

CROSS-REFERENCE TO RELATED APPLICATION

This application claims priority of Taiwanese Application No. 100134766, filed on Sep. 27, 2011.

BACKGROUND OF THE INVENTION

1. Field of the Invention

The present invention relates to a light emitting system, more particularly to a light emitting system with light emitting power stabilization.

2. Description of the Related Art

The forward voltage of a light emitting diode (LED) is influenced by the ambient temperature. FIG. 1 shows a plot of forward voltage vs. ambient temperature obtained for each of a blue LED, a green LED, and a red LED that are driven by a constant driving current of 20 mA. It is evident that a rise in the ambient temperature will cause the forward voltage to fall, such that the light emitting power, or a product of the forward voltage and the operating current, is in a negative relation to the ambient temperature. Hence, application of an LED without implementation of light emitting power control may result in instability in the light emitting power.

Referring to FIG. 2, Taiwanese Patent Application No. 92107029 discloses a conventional light emitting power control circuit 1 for controlling a light emitting power of an LED 15 (e.g., a laser light emitting diode) in an optical pick-up of an optical drive device. The conventional light emitting power control circuit 1 includes a detection module 10, a signal source 11, an integration module 12, and a driving module 13.

The detection module 10 is operable to receive light emitted from the LED 15 and to detect the light emitting power of the LED 15 so as to generate a detection voltage (V3) having a magnitude that is in a positive relation to the light emitting power detected by the detection module 10. The light emitting power is defined by the equation of $P=V_F \times I$, where P, $V_F$, and I are the light emitting power, a forward voltage, and an operating current of the LED 15, respectively.

The detection module 10 includes a light detector 101 and a front-end amplifier 102. Since a description of the operations of these components may be found in the specification of the aforesaid Taiwanese Application, these components will not be described hereinafter for the sake of brevity.

The signal source 11 is operable to generate a reference voltage (V1) that has a magnitude greater than that of the detection voltage (V3) and dynamically configurable according to a target light emitting power.

The integration module 12 is connected electrically to the signal source 11 and the detection module 10 for respectively receiving the reference voltage (V1) and the detection voltage (V3) therefrom, and is operable to output an integration voltage (V2) based on an integration of a difference between the reference voltage (V1) and the detection voltage (V3). When the detection voltage (V3) is reduced as a result of a reduction in the light emitting power, the difference between the reference voltage (V1) and the detection voltage (V3) is increased, causing the integration voltage (V2) to increase. On the other hand, when the detection voltage (V3) is increased as a result of an increase in the light emitting power, the difference between the reference voltage (V1) and the detection voltage (V3) is decreased, causing the integration voltage (V2) to decrease.

The driving module 13 is connected electrically to the integration module 12 for receiving the integration voltage (V2) therefrom, and is connected electrically to the LED 15 for providing to the LED 15 the operating current having a magnitude that is in a positive relation to the integration voltage (V2) received by the driving module 13. The driving module 13 includes an amplifier 131 having an adjustable gain, and a driving unit 132 electrically connected electrically to the amplifier 131. Since a description of the operations of these components may be found in the specification of the aforesaid Taiwanese Application, these components will not be described hereinafter for the sake of brevity.

When the forward voltage of the LED 15 is decreased as a result of an increase in the ambient temperature, the light emitting power is reduced, the detection voltage (V3) generated by the detection module 10 is decreased while the reference voltage (V1) remains unchanged, and the difference between the reference voltage (V1) and the detection voltage (V3) is thus increased such that the integration voltage (V2) and hence the operating current are, as a result, increased. This increase in the operating current serves to compensate for the reduction in the forward voltage, thereby achieving a light emitting power stabilization effect.

It can be understood from the above that the conventional light emitting power control circuit 1 stabilizes the light emitting power through adjusting the operating current according to variations in the detection voltage (V3), which correspond to variations in light detected by the light detector 101 of the detection module 10.

However, since the LED 15 suffers from poor directivity, factors such as distance between and positions of the light detector 101 and the LED 15, ambient light pollution, and sensitivity of the light detector 101 may cause errors in stabilization of the light emitting power, such that the conventional light emitting power control circuit 1 may not be able to effectively stabilize the light emitting power of the LED 15 in response to variations in the ambient temperature.

SUMMARY OF THE INVENTION

Therefore, an object of the present invention is to provide a light emitting system capable of alleviating the aforesaid drawbacks of the prior art.

According to the present invention, a light emitting system with light emitting power stabilization includes:

a solid-state light emitting component having an anode and a cathode, one of which is disposed to receive an input voltage, and having a forward voltage that has a magnitude dependent on ambient temperature when driven under a constant current condition; and a power control device including a detection module including a voltage detecting unit connected electrically across the anode and the cathode of the solid-state light emitting component for detecting the forward voltage, and operable to generate a detection voltage according to the forward voltage detected by the voltage detecting unit, the detection voltage having a magnitude dependent on the forward voltage detected by the voltage detecting unit, and a current control unit connected electrically to the other of the anode and the cathode of the solid-state light emitting component, and operable to control flow of an operating current through the solid-state light emitting component according to a compensation voltage received by the current control unit, the operating current having a magnitude dependent on the compensation voltage received by the current control unit, the current control unit generating an operating voltage according to the operating current, the operating voltage having a magnitude dependent on the operating current, and a compensation voltage module connected electrically to the detection module for receiving the detection voltage and the operating voltage therefrom, disposed to receive a reference voltage, and configured to generate the compensation voltage for provision to the detection module according to the detection voltage, the operating voltage, and the reference voltage received by the compensation voltage module, the compensation voltage varying according to the forward voltage.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
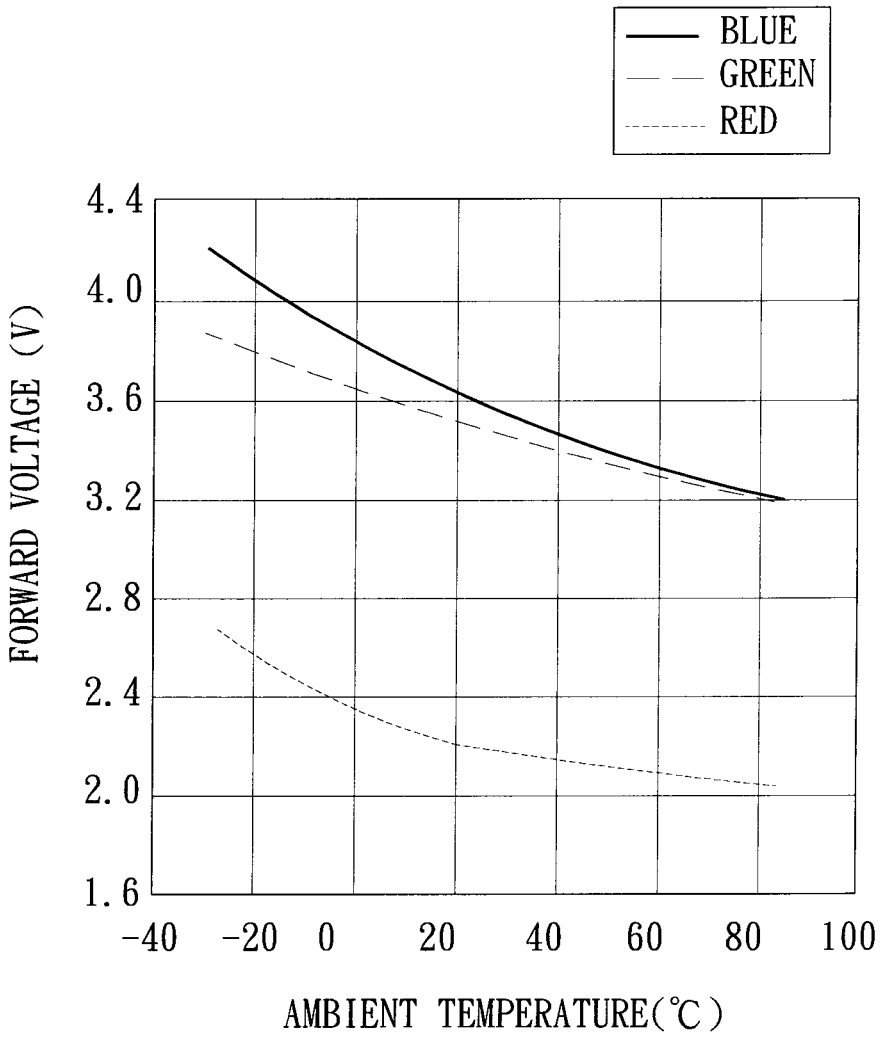
FIG. 1 PRIOR ART
FIG. 1 is a plot of forward voltage vs. ambient temperature obtained for each of a blue light emitting diode, a green light emitting diode, and a red light emitting diode that are independently driven by a constant driving current.
Figure 2:
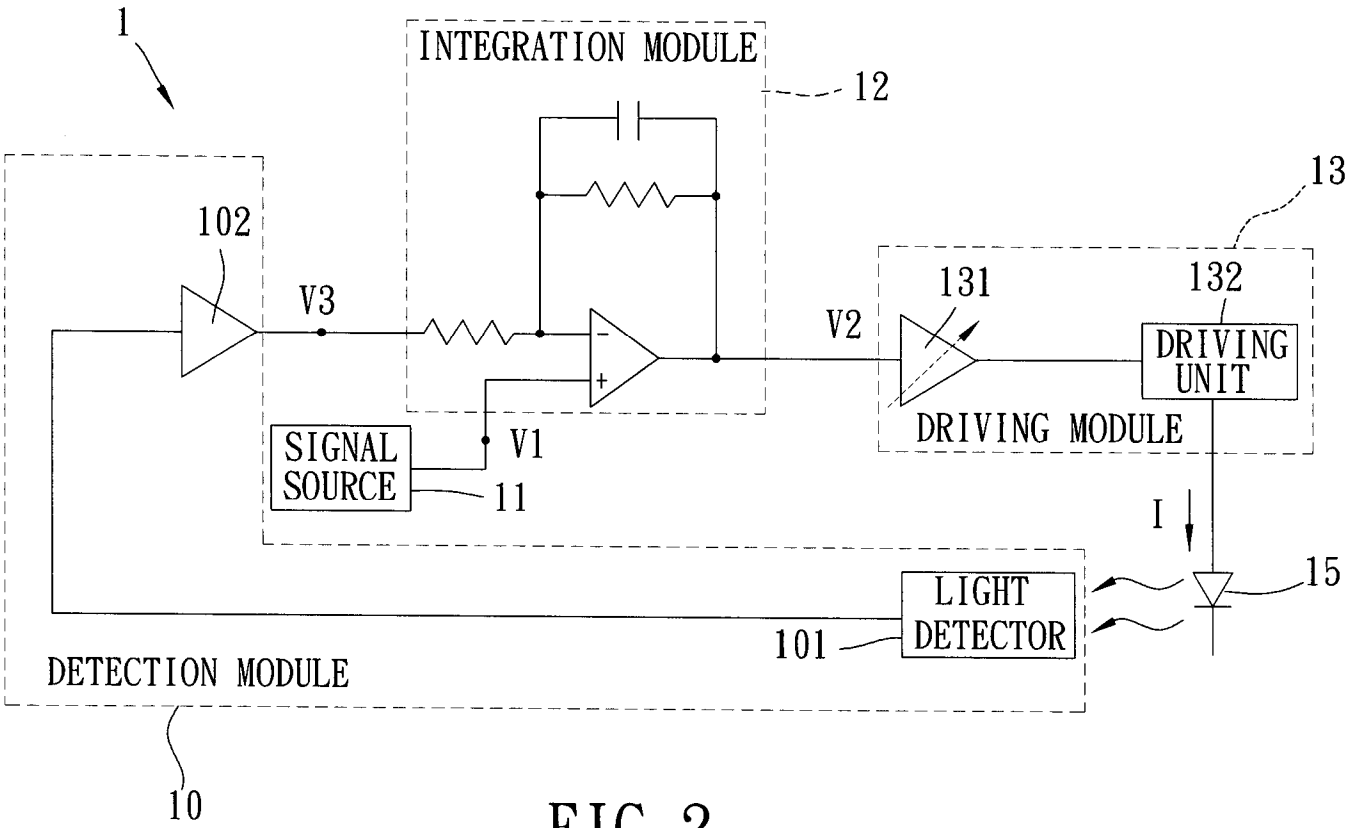
FIG. 2 PRIOR ART
FIG. 2 is a circuit block diagram to illustrate a conventional light emitting system.

Before the present invention is described in greater detail, it should be noted that like elements are denoted by the same reference numerals throughout the disclosure.

Figure 3:
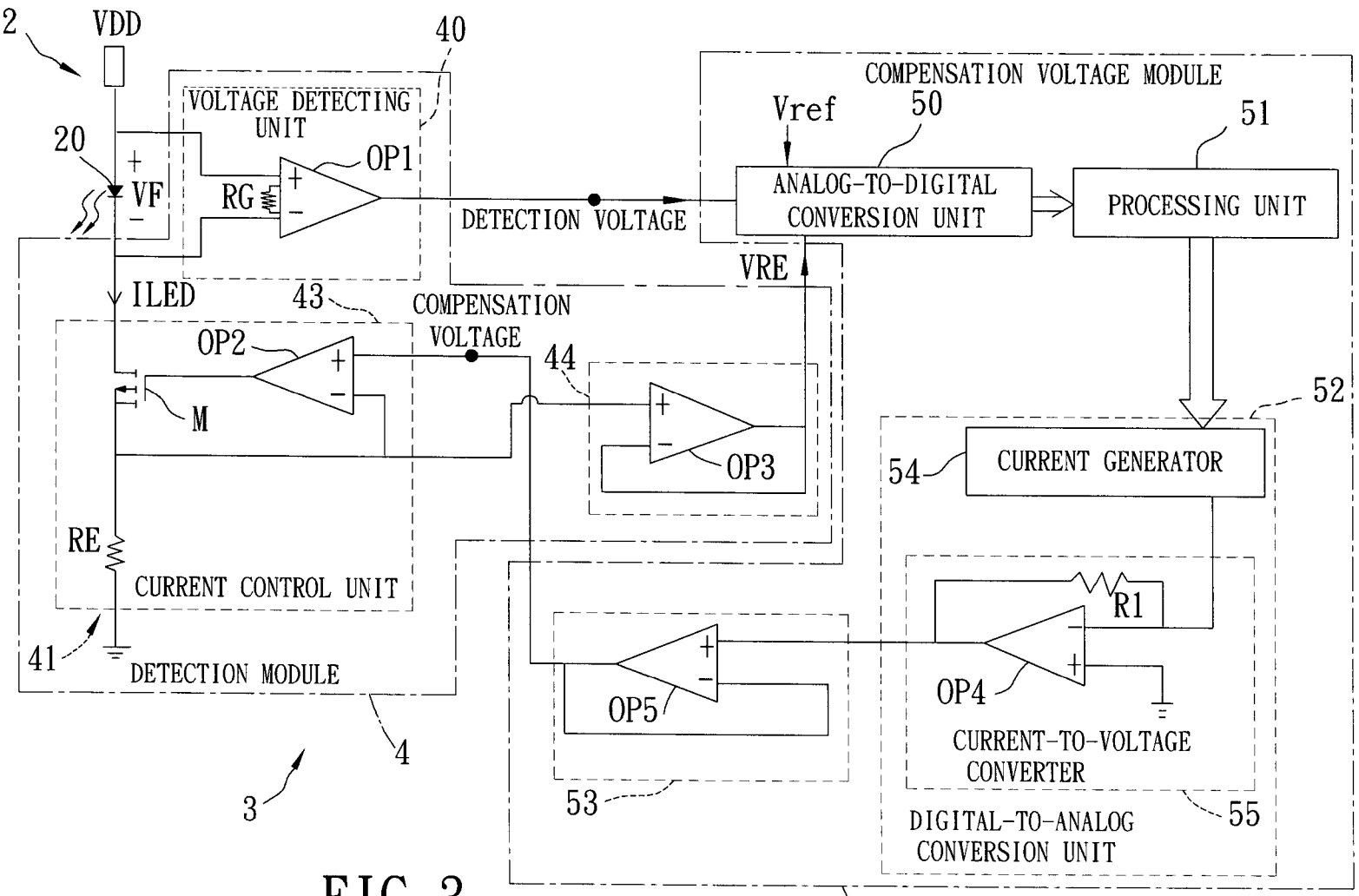
FIG. 3 is a circuit block diagram to illustrate the preferred embodiment of a light emitting system with light emitting power stabilization, according to the present invention.

Referring to FIG. 3, the preferred embodiment of a light emitting system 2 with light emitting power stabilization according to the present invention includes a solid-state light emitting component 20 and a power control device 3.

The solid-state light emitting component 20 has a forward voltage (VF) having a magnitude that is in a negative relation to ambient temperature when driven under a constant current condition, and has an anode disposed to receive an input bias voltage (VDD), and a cathode.

The power control device 3 includes a detection module 4 and a compensation voltage module 5.

The detection module 4 includes a voltage detecting unit 40 and a current control unit 41.

The voltage detecting unit 40 is connected electrically across the anode and the cathode of the solid-state light emitting component 20 for detecting the forward voltage (VF), and is operable to generate a detection voltage according to the forward voltage (VF) detected thereby. The detection voltage is in a positive relation to the forward voltage (VF). Thus, when the ambient temperature changes, the forward voltage (VF) satisfies equation 1

$$VF=V_{LED}+\Delta V_{LED} \quad (1)$$

where $V_{LED}$ represents a value of the forward voltage (VF) when the ambient temperature is equal to "t", and $\Delta V_{LED}$ represent a change in value of the forward voltage (VF) when a variation in ambient temperature is equal to "Δt".

In this embodiment, the voltage detecting unit 40 includes a first amplifier (OP1), and a variable gain resistor (RG) connected electrically to the first amplifier (OP1). The first amplifier (OP1) is an instrumentation amplifier having a gain that may be adjusted through adjusting the variable gain resistor (RG).

The first amplifier (OP1) has non-inverting and inverting input terminals connected electrically and respectively to the anode and the cathode of the solid-state light emitting component 20 for detecting the forward voltage (VF), is operable to generate the detection voltage according to the forward voltage (VF) detected by the first amplifier (OP1), and further has an output terminal for outputting the detection voltage, wherein the detection voltage has a magnitude that is dependent on the forward voltage (VF) detected by the first amplifier (OP1). In this embodiment, since the variable gain resistor (RG) is adjusted such that the first amplifier (OP1) has unity gain, the detection voltage is substantially identical to the forward voltage (VF).

The current control unit 41 is connected electrically to the cathode of the solid-state light emitting component 20, and is operable to control flow of an operating current (ILED) through the solid-state light emitting component 20 according to a compensation voltage received by the current control unit 41. The operating current (ILED) has a magnitude that is in a positive relation to the compensation voltage received by the current control unit 41.

In this embodiment the current control unit 41 includes a voltage-to-current converting unit 43 and a first buffer unit 44.

The voltage-to-current converting unit 43 includes a transistor (M), a second amplifier (OP2), and a resistor (RE).

The transistor (M) has a first terminal that is connected electrically to the cathode of the solid-state light emitting component 20, a second terminal that is connected to ground via the resistor (RE), and a control terminal. In this embodiment, the transistor (M) is an n-type metal-oxide-semiconductor field-effect transistor (MOSFET) having a drain terminal, a source terminal, and a gate terminal that serve as the first terminal, the second terminal, and the control terminal, respectively.

The second amplifier (OP2) is an operational amplifier that has an inverting terminal connected electrically to the second terminal of the transistor (M), a non-inverting terminal disposed to receive the compensation voltage, and an output terminal connected electrically to the control terminal of the transistor (M). The second amplifier (OP2) is operable to output a control voltage via the output terminal thereof for controlling switching of the transistor (M) and hence provision of the operating current (ILED) through the solid-state light emitting component 20 according to the compensation voltage received by the second amplifier (OP2).

The resistor (RE) has a resistance value of $R_E$. A voltage at the second terminal of the transistor (M) is equal to a product of the operating current (ILED) and the resistance value $R_E$, and serves as a feedback voltage. Due to a virtual short circuit effect between the inverting and non-inverting input terminals of the second amplifier (OP2), the operating current (ILED) is equal to a result of division of the compensation voltage by the resistance value $R_E$.

The first buffer unit 44 includes a third amplifier (OP3) serving to increase an input impedance, and having a non-inverting input terminal that is connected electrically to the second terminal of the transistor (M) for receiving the feedback voltage therefrom, and an inverting input terminal and an output terminal that are connected electrically to each other. The third amplifier (OP3) is an operational amplifier operable to generate an operating voltage (VRE) according to the feedback voltage received thereby, and to output the operating voltage (VRE) via the output terminal thereof, wherein the operating voltage (VRE) has a magnitude identical to that of the feedback voltage, which is dependent on the operating current.

Figure 4:
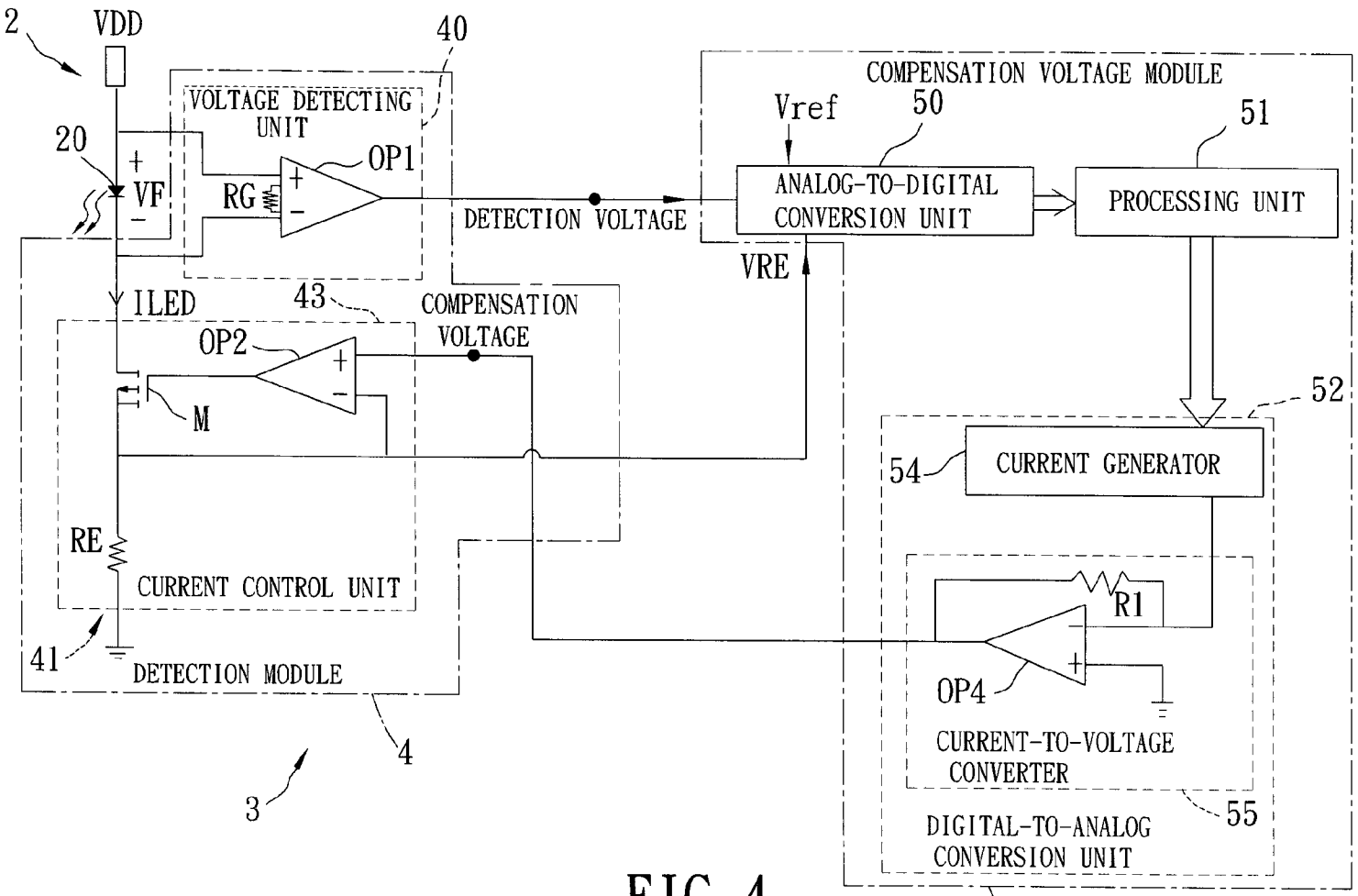
FIG. 4 is a circuit block diagram to illustrate a modification of the preferred embodiment.

It is to be noted that, in a modification where the first buffer unit 44 is omitted (see FIG. 4), the feedback voltage, which is the voltage at the second terminal of the transistor (M), is provided to the compensation voltage module 5 to serve as the operating voltage (VRE).

The compensation voltage module 5 is connected electrically to the detection module 4 for receiving the detection voltage and the operating voltage (VRE) therefrom, is disposed to receive a reference voltage (Vref), and is configured to generate the compensation voltage for provision to the detection module 4 according to the detection voltage, the operating voltage (VRE), and the reference voltage (Vref) received by the compensation voltage module 5.

The compensation voltage module 5 includes an analog-to-digital conversion unit 50, a processing unit 51, a digital-to-analog conversion unit 52, and a second buffer unit 53.

The analog-to-digital conversion unit 50 is connected electrically to the third amplifier (OP3) for receiving the operating voltage (VRE) therefrom, is connected electrically to the first amplifier (OP1) to receive the detection voltage therefrom, is disposed to receive the reference voltage (Vref), and is operable to perform analog-to-digital conversion upon the operating voltage (VRE), the detection voltage, and the reference voltage (Vref) received by the analog-to-digital conversion unit 50 so as to generate a digital operating signal, a digital detection signal, and a digital reference signal, respectively.

The processing unit 51 is connected electrically to the analog-to-digital conversion unit 50 for receiving the digital operating signal, the digital detection signal, and the digital reference signal therefrom, and is operable to generate a digital compensation signal according to the signals received by the processing unit 51. The digital compensation signal thus generated satisfies equation 2

$$VC_d G \times \{Vref_d - [VRE_d \times Vdet_d]\} \tag{2}$$

where $VC_d$ represents the digital compensation signal, G represents a gain, $Vref_d$ represents the digital reference signal, $VRE_d$ represents the digital operating signal, and $Vdet_d$ represents the digital detection signal.

In practice, the analog-to-digital conversion unit 50 and the processing unit 51 may be implemented using a microprocessor.

The digital-to-analog conversion unit 52 is connected electrically to the processing unit 51 for receiving the digital compensation signal therefrom, and is operable to generate a compensation voltage signal according to the digital compensation signal received by the digital-to-analog conversion unit 52. The digital-to-analog conversion unit 52 includes a current generator 54 and a current-to-voltage converter 55.

The current generator 54 is connected electrically to the processing unit 51 for receiving the digital compensation signal therefrom, and is operable to generate a compensation current signal according to the digital compensation signal received by the current generator 54.

The current-to-voltage converter 55 is connected electrically to the current generator 54 for receiving the compensation current signal therefrom, and is operable to generate the compensation voltage signal according to the compensation current signal received by the current-to-voltage converter 55. In this embodiment, the current-to-voltage converter 55 includes a feedback resistor (R1) and a fourth amplifier (OP4), which is an operational amplifier.

The fourth amplifier (OP4) has a grounded non-inverting input terminal, an inverting input terminal connected electrically to the current generator 54 for receiving the compensation current signal therefrom, and an output terminal connected electrically to the inverting input terminal via the feedback resistor (R1), and is operable to generate the compensation voltage signal for output via the output terminal.

The second buffer unit 53 includes a fifth amplifier (OP5) serving to increase an input impedance, and having a non-inverting input terminal that is connected electrically to the output terminal of the fourth amplifier (OP4) for receiving the compensation voltage signal therefrom, an output terminal connected electrically to the non-inverting input terminal of the second amplifier (OP2), and an inverting input terminal connected electrically to the output terminal of the fifth amplifier (OP5). The fifth amplifier (OP5) is an operational amplifier operable to generate the compensation voltage according to the compensation voltage signal received thereby via the non-inverting input terminal, and to output the compensation voltage to the second amplifier (OP2) via the output terminal of the fifth amplifier (OP5), wherein, in this embodiment, the fifth amplifier (OP5) is configured such that the compensation voltage has a magnitude identical to that of the compensation voltage signal. Thus, the compensation voltage varies according to the forward voltage (VF), thereby achieving light emitting power stabilization.

It is to be noted that, in a modification where the second buffer unit 53 is omitted (see FIG. 4), the output terminal of the fourth amplifier (OP4) is connected electrically and directly to the non-inverting input terminal of the second amplifier (OP2), such that the compensation voltage signal outputted by the fourth amplifier (OP4) is provided to the second amplifier (OP2) to serve as the compensation voltage.

In the aforesaid configuration, based on equations 1 and 2, the operating current generated by the detection module 4 satisfies equation 3

$$\begin{aligned} ILED &= \frac{G \times \{Vref - [VRE \times (V_{LED} + \Delta V_{LED})]\}}{R_E} \\ &= \frac{G \times \{Vref - [VRE \times V_{LED}]\}}{R_E} - \frac{G \times VRE \times \Delta V_{LED}}{R_E} \end{aligned} \tag{3}$$

Equation 4 may be obtained by substituting VRE=ILED× $R_E$ into equation 3.

$$ILED = \frac{Vref}{R_E} \times \frac{G}{1 + G \times (V_{LED} + \Delta V_{LED})} \tag{4}$$

It can be understood from equation 4 that, when the ambient temperature rises, the change in value of the forward voltage (VF) is negative (i.e., $\Delta V_{LED}<0$), causing the forward voltage (VF) to decrease, which, in turn, causes the operating current (ILED) to increase. On the other hand, when the ambient temperature falls, the change in value of the forward voltage (VF) is positive (i.e., $\Delta V_{LED}>0$), causing the forward voltage (VF) to increase, which, in turn, causes the operating current (ILED) to decrease.

When the gain (i.e., the value of G) is large enough, equation 4 may be simplified into equation 5.

$$ILED = \frac{Vref}{R_E} \times \frac{1}{V_{LED} + \Delta V_{LED}} \quad (5)$$

Thus, a light emitting power of the solid-state light emitting component 20 may be defined by equation 6.

$$P = ILED \times (V_{LED} + \Delta V_{LED}) = \frac{Vref}{R_E} \quad (5)$$

where P represents the light emitting power of the solid-state light emitting component 20.

Figure 5:
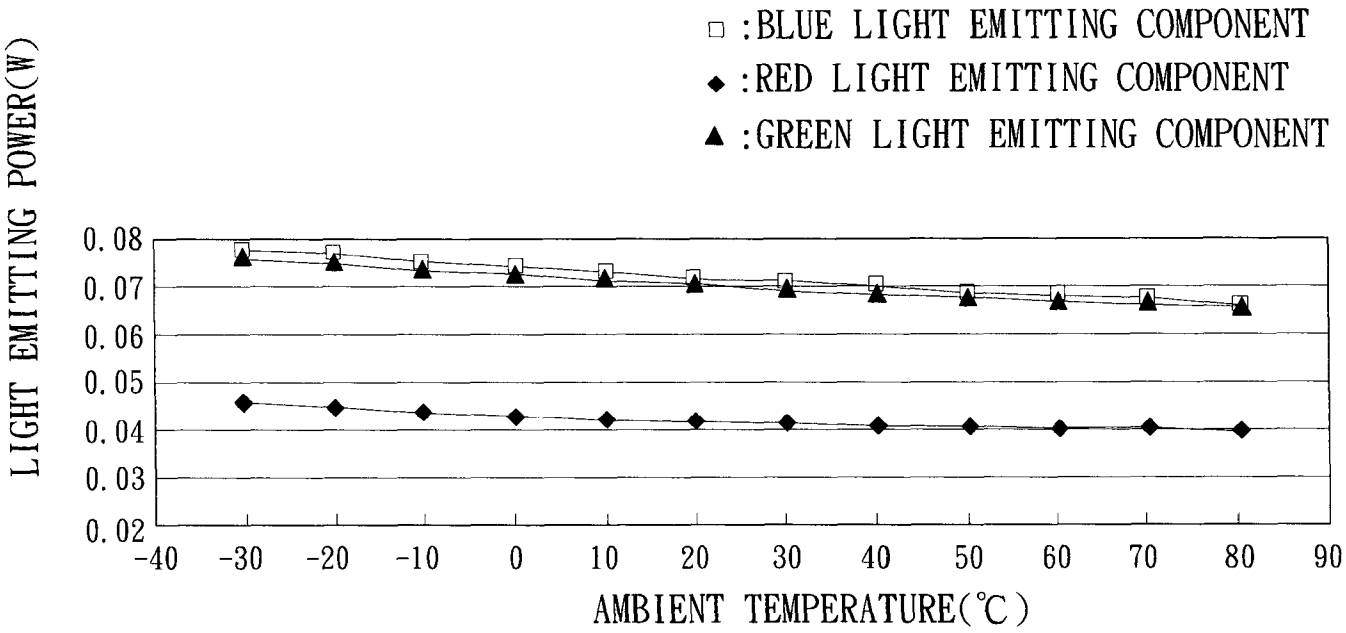
FIG. 5 is a plot of light emitting power vs. ambient temperature obtained for the light emitting system of this invention, where a power control device of the light emitting system is configured to control flow of a continuous wave constant current.

Shown in FIG. 5 is a plot of light emitting power vs. ambient temperature obtained for each of a red light emitting diode, a green light emitting diode, and a blue light emitting diode that are individually driven by the power control device 3 of the preferred embodiment of the present invention. It is apparent that each of the red, green and blue light emitting diodes exhibits a substantially non-varying light emitting power within the temperature range of −30° C. to 80° C.

It is to be noted that, in the preferred embodiment, the power control device 3 is configured such that the operating current (ILED) generated thereby is a continuous wave constant current.

Figure 6:
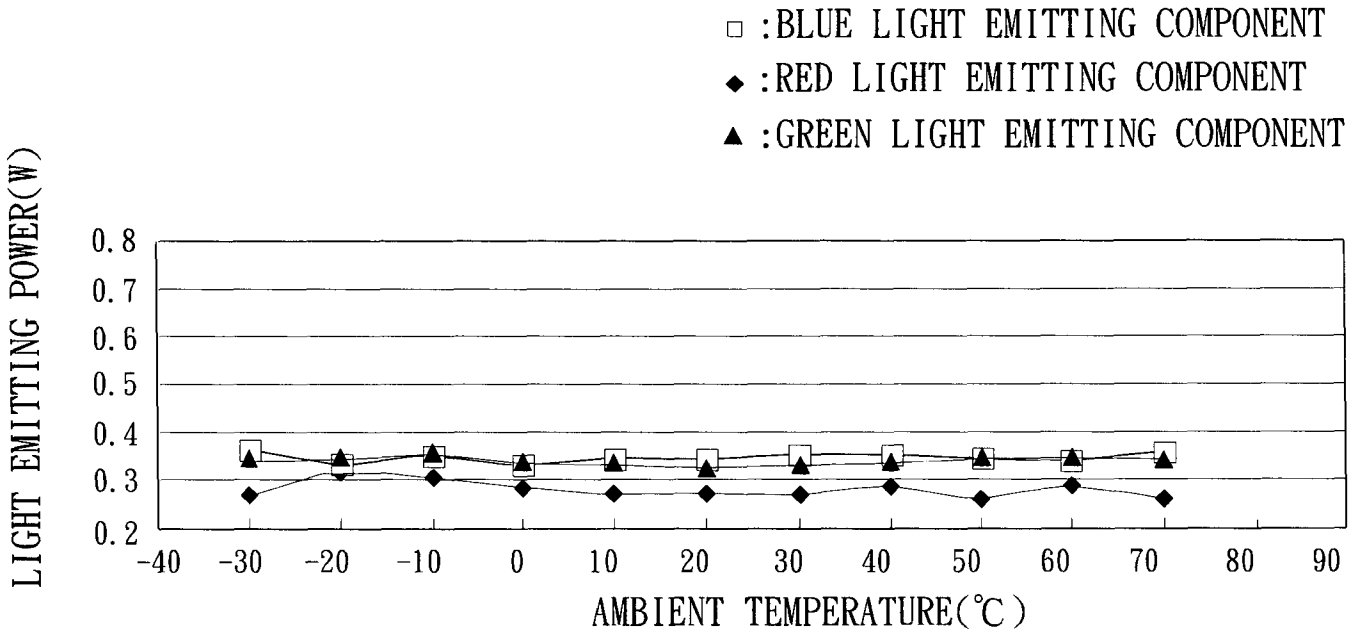
FIG. 6 is a plot of light emitting power vs. ambient temperature obtained for the light emitting system of this invention, where the power control device of the light emitting system is configured to control flow of a pulse wave constant current.

Shown in FIG. 6 is a plot of light emitting power vs. ambient temperature obtained for each of a red light emitting diode, a green light emitting diode, and a blue light emitting diode that are individually driven by the power control device 3 of a modification, wherein the power control device 3 is configured such that the operating current (ILED) generated thereby is a pulse wave constant current having a frequency of 10 Hz and a duty ratio of 10%. In the modification, the digital compensation signal alternates between 0 and 1. In particular, during each time period of 100 ms, the digital compensation signal has a value that satisfies equation 2 for 10 ms and that is equal to 0 for 90 ms.

Since the operating current (ILED) is related to the compensation voltage (VC) and the resistor ($R_E$), the operating current (ILED) has a pulse width dependent on the duty ratio of the digital compensation signal, the compensation voltage received by the voltage-to-current converting unit 43 and hence the operating current (ILED) generated by the same have a non-continuous waveform characterized by a frequency of 10 Hz and a duty ratio of 10%.

In summary, since the detection module 4 is connected electrically and directly to the solid-state light emitting component 20 for detecting the forward voltage (VF), stabilization of the light emitting power according to the forward voltage (VF) detected by the detection module 4 is not susceptible to directivity of light emitted by the solid-state light emitting component 20 and ambient light pollution, thereby alleviating the aforesaid drawbacks of the prior art. Furthermore, heat generated by the solid-state light emitting component 20 may be reduced through adjusting the pulse width of the operating current (ILED).

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A light emitting system with light emitting power stabilization, comprising: a solid-state light emitting component having an anode and a cathode, one of which is disposed to receive an input voltage, and having a forward voltage that has a magnitude dependent on ambient temperature when driven under a constant current condition; and a power control device including a detection module including a voltage detecting unit connected electrically across said anode and said cathode of said solid-state light emitting component for detecting the forward voltage, and operable to generate a detection voltage according to the forward voltage detected by said voltage detecting unit, the detection voltage having a magnitude dependent on the forward voltage detected by said voltage detecting unit, and a current control unit connected electrically to the other of said anode and said cathode of said solid-state light emitting component, and operable to control flow of an operating current through said solid-state light emitting component according to a compensation voltage received by said current control unit, the operating current having a magnitude dependent on the compensation voltage received by said current control unit, said current control unit generating an operating voltage according to the operating current, the operating voltage having a magnitude dependent on the operating current, and a compensation voltage module connected electrically to said detection module for receiving the detection voltage and the operating voltage therefrom, disposed to receive a reference voltage, and configured to generate the compensation voltage for provision to said detection module according to the detection voltage, the operating voltage, and the reference voltage received by said compensation voltage module, the compensation voltage varying according to the forward voltage.

2. The light emitting system as claimed in claim 1, wherein said current control unit includes a resistor, a transistor having a first terminal that is connected electrically the other of said anode and said cathode of said solid-state light emitting component, a second terminal that is connected electrically to ground via said resistor, and a control terminal, a voltage at said second terminal serving as a feedback voltage, and a first operational amplifier having a first input terminal that is connected electrically to said second terminal of said transistor, a second input terminal that is disposed to receive the compensation voltage, and an output terminal that is connected electrically to said control terminal of said transistor, said first operational amplifier being operable to generate a control voltage for output via said output terminal of said first operational amplifier so as to switch said transistor according to the compensation voltage received by said first operational amplifier.

3. The light emitting system as claimed in claim 2, wherein said current control unit further includes a first buffer unit connected electrically to said second terminal of said transistor for receiving the feedback voltage therefrom, operable to generate the operating voltage according to the feedback voltage received by said first buffer unit, and further connected electrically to said compensation voltage module for providing the operating voltage to said compensation voltage module, the operating voltage having a magnitude dependent on the feedback voltage.

4. The light emitting system as claimed in claim 3, wherein said first buffer unit of said current control unit includes a second operational amplifier having a first input terminal that is connected electrically to said second terminal of said transistor for receiving the feedback voltage therefrom, an output terminal that is connected electrically to said compensation voltage module, and a second input terminal that is connected electrically to said output terminal of said second operational amplifier, said second operational amplifier being operable to generate the operating voltage for provision to said compensation voltage module via said output terminal of said second operational amplifier according to the feedback voltage received by said second operational amplifier.

5. The light emitting system as claimed in claim 2, wherein said transistor is an n-type metal-oxide-semiconductor field-effect transistor having a drain terminal, a source terminal, and a gate terminal that serve as said first terminal, said second terminal, and said control terminal of said transistor, respectively.

6. The light emitting system as claimed in claim 2, wherein the feedback voltage is provided to said compensation voltage module to serve as the operating voltage.

7. The light emitting system as claimed in claim 1, wherein said compensation voltage module includes: an analog-to-digital conversion unit connected electrically to said detection module for receiving the detection voltage and the operating voltage from said detection module, disposed to receive the reference voltage, and operable to perform analog-to-digital conversion upon the detection voltage, the operating voltage, and the reference voltage so as to generate a digital detection signal, a digital operating signal, and a digital reference signal, respectively; a processing unit connected electrically to said analog-to-digital conversion unit for receiving the digital detection signal, the digital operating signal, and the digital reference signal from said analog-to-digital conversion unit, and operable to generate a digital compensation signal according to the digital detection signal, the digital operating signal, and the digital reference signal received by said processing unit, the digital compensation signal satisfying VC.sub.dG.times.{Vref.sub.d−[VRE.sub.d.times.Vdet-.sub.d]} where VC.sub.d represents the digital compensation signal, G represents a gain, Vref.sub.d represents the digital reference signal, VRE.sub.d represents the digital operating signal, and Vdet.sub.d represents the digital detection signal; and a digital-to-analog conversion unit connected electrically to said processing unit for receiving the digital compensation signal from said processing unit, and operable to generate a compensation voltage signal according to the digital compensation voltage received by said digital-to-analog conversion unit, the compensation voltage corresponding to the compensation voltage signal.

8. The light emitting system as claimed in claim 7, wherein said digital-to-analog conversion unit includes a current generator connected electrically to said processing unit for receiving the digital compensation signal from said processing unit, and operable to generate a compensation current signal according to the digital compensation signal received by said current generator, and a current-to-voltage converter connected electrically to said current generator for receiving the compensation current signal from said current generator, and operable to generate the compensation voltage signal according to the compensation current signal received by said current-to-voltage converter.

9. The light emitting system as claimed in claim 8, wherein said current-to-voltage converter includes a feedback resistor, and a third operational amplifier having a first input terminal that is connected electrically to said current generator for receiving the compensation current signal from said current generator, a grounded second input terminal, and an output terminal that is connected electrically to said first input terminal of said third operational amplifier via said feedback resistor, said third operational amplifier being operable to generate the compensation voltage signal for output via said output terminal thereof.

10. The light emitting system as claimed in claim 7, wherein said compensation voltage module further includes a second buffer unit connected electrically to said digital-to-analog conversion unit for receiving the compensation voltage signal from said digital-to-analog conversion unit, operable to generate the compensation voltage according to the compensation voltage signal received by said second buffer unit, and connected electrically to said current control unit for providing the compensation voltage to said current control unit, the compensation voltage having a magnitude that is dependent on the compensation voltage signal.

11. The light emitting system as claimed in claim 10, wherein said second buffer unit includes a fourth operational amplifier having a first input terminal that is connected electrically to said digital-to-analog conversion unit for receiving the compensation voltage signal from said digital-to-analog conversion unit, an output terminal that is connected electrically to said current control unit, and a second input terminal that is connected electrically to said output terminal of said fourth operational amplifier, said fourth operational amplifier being operable to generate the compensation voltage for provision to said current control unit via said output terminal of said fourth operational amplifier according to the compensation voltage signal received by said fourth operational amplifier.

12. The light emitting system as claimed in claim 9, wherein the compensation voltage signal is provided to said current control unit to serve as the compensation voltage.

13. The light emitting system as claimed in claim 1, wherein said solid-state light emitting component is one of a light emitting diode and a laser diode.

14. A power control device adapted to be connected electrically to a solid-state light emitting component that has an anode and a cathode, one of which is disposed to receive an input voltage, and that has a forward voltage with a magnitude dependent on ambient temperature when the solid-state light emitting component is driven under a constant current condition, said power control device comprising: a detection module including a voltage detecting unit to be connected electrically across the anode and the cathode of the solid-state light emitting component for detecting the forward voltage, and operable to generate a detection voltage according to the forward voltage detected by said voltage detecting unit, the detection voltage having a magnitude dependent on the forward voltage detected by said voltage detecting unit, and a current control unit to be connected electrically to the other of the anode and the cathode of the solid-state light emitting component, and operable to control flow of an operating current through the solid-state light emitting component according to a compensation voltage received by said current control unit, the operating current having a magnitude dependent on the compensation voltage received by said current control unit, said current control unit generating an operating voltage according to the operating current, the operating voltage having a magnitude dependent on the operating current; and a compensation voltage module connected electrically to said detection module for receiving the detection voltage and the operating voltage therefrom, disposed to receive a reference voltage, and configured to generate the compensation voltage for provision to said detection module according to the detection voltage, the operating voltage, and the reference voltage received by said compensation voltage module, the compensation voltage varying according to the forward voltage.

15. The power control device as claimed in claim 14, wherein said current control unit includes a resistor, a transistor having a first terminal that is to be connected electrically the other of the anode and the cathode of the solid-state light emitting component, a second terminal that is connected electrically to ground via said resistor, and a control terminal, a voltage at said second terminal serving as a feedback voltage, and a first operational amplifier having a first input terminal that is connected electrically to said second terminal of said transistor, a second input terminal that is disposed to receive the compensation voltage, and an output terminal that is connected electrically to said control terminal of said transistor, said first operational amplifier being operable to generate a control voltage for output via said output terminal of said first operational amplifier so as to switch said transistor according to the compensation voltage received by said first operational amplifier.

16. The power control device as claimed in claim 15, wherein said current control unit further includes a first buffer unit connected electrically to said second terminal of said transistor for receiving the feedback voltage therefrom, operable to generate the operating voltage according to the feedback voltage received by said first buffer unit, and further connected electrically to said compensation voltage module for providing the operating voltage to said compensation voltage module, the operating voltage having a magnitude dependent on the feedback voltage.

17. The power control device as claimed in claim 16, wherein said first buffer unit of said current control unit includes a second operational amplifier having a first input terminal that is connected electrically to said second terminal of said transistor for receiving the feedback voltage therefrom, an output terminal that is connected electrically to said compensation voltage module, and a second input terminal that is connected electrically to said output terminal of said second operational amplifier, said second operational amplifier being operable to generate the operating voltage for provision to said compensation voltage module via said output terminal of said second operational amplifier according to the feedback voltage received by said second operational amplifier.

18. The power control device as claimed in claim 15, wherein said transistor is an n-type metal-oxide-semiconductor field-effect transistor having a drain terminal, a source terminal, and a gate terminal that serve as said first terminal, said second terminal, and said control terminal of said transistor, respectively.

19. The power control device as claimed in claim 15, wherein the feedback voltage is provided to said compensation voltage module to serve as the operating voltage.

20. The power control device as claimed in claim 14, wherein said compensation voltage module includes: an analog-to-digital conversion unit connected electrically to said detection module for receiving the detection voltage and the operating voltage from said detection module, disposed to receive the reference voltage, and operable to perform analog-to-digital conversion upon the detection voltage, the operating voltage, and the reference voltage so as to generate a digital detection signal, a digital operating signal, and a digital reference signal, respectively; a processing unit connected electrically to said analog-to-digital conversion unit for receiving the digital detection signal, the digital operating signal, and the digital reference signal from said analog-to-digital conversion unit, and operable to generate a digital compensation signal according to the digital detection signal, the digital operating signal, and the digital reference signal received by said processing unit, the digital compensation signal satisfying VC.sub.d=G.times.{Vref.sub.d[VRE.sub.d-.times.Vdet.sub.d]} where VC.sub.d represents the digital compensation signal, G represents a gain, Vref.sub.d represents the digital reference signal, VRE.sub.d represents the digital operating signal, and Vdet.sub.d represents the digital detection signal; and a digital-to-analog conversion unit connected electrically to said processing unit for receiving the digital compensation signal from said processing unit, and operable to generate a compensation voltage signal according to the digital compensation voltage received by said digital-to-analog conversion unit, the compensation voltage corresponding to the compensation voltage signal.

21. The power control device as claimed in claim 20, wherein said digital-to-analog conversion unit includes a current generator connected electrically to said processing unit for receiving the digital compensation signal from said processing unit, and operable to generate a compensation current signal according to the digital compensation signal received by said current generator, and a current-to-voltage converter connected electrically to said current generator for receiving the compensation current signal from said current generator, and operable to generate the compensation voltage signal according to the compensation current signal received by said current-to-voltage converter.

22. The power control device as claimed in claim 21, wherein said current-to-voltage converter includes a feedback resistor, and a third operational amplifier having a first input terminal that is connected electrically to said current generator for receiving the compensation current signal from said current generator, a grounded second input terminal, and an output terminal that is connected electrically to said first input terminal of said third operational amplifier via said feedback resistor, said third operational amplifier being operable to generate the compensation voltage signal for output via said output terminal thereof.

23. The power control device as claimed in claim 20, wherein said compensation voltage module further includes a second buffer unit connected electrically to said digital-to-analog conversion unit for receiving the compensation voltage signal from said digital-to-analog conversion unit, operable to generate the compensation voltage according to the compensation voltage signal received by said second buffer unit, and connected electrically to said current control unit for providing the compensation voltage to said current control unit, the compensation voltage having a magnitude that is dependent on the compensation voltage signal.

24. The power control device as claimed in claim 23, wherein said second buffer unit includes a fourth operational amplifier having a first input terminal that is connected electrically to said digital-to-analog conversion unit for receiving the compensation voltage signal from said digital-to-analog conversion unit, an output terminal that is connected electrically to said current control unit, and a second input terminal that is connected electrically to said output terminal of said fourth operational amplifier, said fourth operational amplifier being operable to generate the compensation voltage for provision to said current control unit via said output terminal of said fourth operational amplifier according to the compensation voltage signal received by said fourth operational amplifier.

25. The power control device as claimed in claim 22, wherein the compensation voltage signal is provided to said current control unit to serve as the compensation voltage.

26. A compensation voltage module for use with a solid-state light emitting component and a detection module, the solid-state light emitting component having an anode and a cathode, one of which is disposed to receive an input voltage, and having a forward voltage that has a magnitude dependent on ambient temperature when driven under a constant current condition, the detection module including a voltage detecting unit and a current control unit, the voltage detecting unit being connected electrically across the anode and the cathode of the solid-state light emitting component for detecting the forward voltage, and being operable to generate a detection voltage according to the forward voltage detected by the voltage detecting unit, the detection voltage having a magnitude dependent on the forward voltage detected by the voltage detecting unit, the current control unit being connected electrically to the other of the anode and the cathode of the solid-state light emitting component, and being operable to control flow of an operating current through the solid-state light emitting component according to a compensation voltage received by the current control unit, the operating current having a magnitude dependent on the compensation voltage received by the current control unit, the current control unit being operable to generate an operating voltage according to the operating current, the operating voltage having a magnitude dependent on the operating current, said compensation voltage module being adapted to generate the compensation voltage that varies according to the forward voltage and comprising: an analog-to-digital conversion unit to be connected electrically to the detection module for receiving the detection voltage and the operating voltage from the detection module, disposed to receive a reference voltage, and operable to perform analog-to-digital conversion upon the detection voltage, the operating voltage, and the reference voltage so as to generate a digital detection signal, a digital operating signal, and a digital reference signal, respectively; a processing unit connected electrically to said analog-to-digital conversion unit for receiving the digital detection signal, the digital operating signal, and the digital reference signal from said analog-to-digital conversion unit, and operable to generate a digital compensation signal according to the digital detection signal, the digital operating signal, and the digital reference signal received by said processing unit; and a digital-to-analog conversion unit connected electrically to said processing unit for receiving the digital compensation signal from said processing unit, and operable to generate a compensation voltage signal according to the digital compensation voltage received by said digital-to-analog conversion unit, the compensation voltage corresponding to the compensation voltage signal.

27. The compensation voltage module as claimed in claim 26, wherein said digital-to-analog conversion unit includes a current generator connected electrically to said processing unit for receiving the digital compensation signal from said processing unit, and operable to generate a compensation current signal according to the digital compensation signal received by said current generator, and a current-to-voltage converter connected electrically to said current generator for receiving the compensation current signal from said current generator, and operable to generate the compensation voltage signal according to the compensation current signal received by said current-to-voltage converter.

28. The compensation voltage module as claimed in claim 27, wherein said current-to-voltage converter includes a feedback resistor, and an operational amplifier having a first input terminal that is connected electrically to said current generator for receiving the compensation current signal from said current generator, a grounded second input terminal, and an output terminal that is connected electrically to said first input terminal of said operational amplifier via said feedback resistor, said operational amplifier being operable to generate the compensation voltage signal for output via said output terminal thereof.

29. The compensation voltage module as claimed in claim 26, further comprising a buffer unit connected electrically to said digital-to-analog conversion unit for receiving the compensation voltage signal from said digital-to-analog conversion unit, operable to generate the compensation voltage according to the compensation voltage signal received by said buffer unit, and to be connected electrically to the current control unit for providing the compensation voltage to the current control unit, the compensation voltage having a magnitude that is dependent on the compensation voltage signal.

30. The compensation voltage module as claimed in claim 29, wherein said buffer unit includes an operational amplifier having a first input terminal that is connected electrically to said digital-to-analog conversion unit for receiving the compensation voltage signal from said digital-to-analog conversion unit, an output terminal that is to be connected electrically to the current control unit, and a second input terminal that is connected electrically to said output terminal of said operational amplifier, said operational amplifier being operable to generate the compensation voltage for provision to the current control unit via said output terminal of said operational amplifier according to the compensation voltage signal received by said operational amplifier.

31. The compensation voltage module as claimed in claim 28, wherein the compensation voltage signal is to be provided to the current control unit to serve as the compensation voltage.

32. The compensation voltage module as claimed in claim 26, wherein the digital compensation signal satisfies VC.sub.d=G.times.{Vref.sub.d−[VRE.sub.d.times.Vdet-.sub.d]} where VC.sub.d represents the digital compensation signal, G represents a gain, Vref.sub.d represents the digital reference signal, VRE.sub.d represents the digital operating signal, and Vdet.sub.d represents the digital detection signal.

* * * * *